US005482066A

United States Patent [19]

Krueger

[11] Patent Number: 5,482,066

[45] Date of Patent: Jan. 9, 1996

[54] PARTS WASHING MACHINE

[75] Inventor: Milton W. Krueger, Kearney, Mo.

[73] Assignee: Kemac, Inc., Kearney, Mo.

[21] Appl. No.: 179,102

[22] Filed: Jan. 11, 1994

[51] Int. Cl.[6] ..... B08B 3/02

[52] U.S. Cl. ..... 134/111; 134/153; 134/157; 134/200; 134/141; 476/64

[58] Field of Search ..... 134/111, 140, 134/141, 135, 153, 157, 200; 74/380, 384; 477/17; 476/164

[56] References Cited

U.S. PATENT DOCUMENTS

| | | | |
|---|---|---|---|
| 1,396,466 | 11/1921 | Roever | 134/153 X |
| 1,653,219 | 12/1927 | Lathrop | 134/153 X |
| 3,118,458 | 1/1964 | Dannemann et al. | 134/200 X |
| 3,327,722 | 6/1967 | Nolte | 134/111 |
| 3,624,750 | 11/1971 | Peterson | 134/153 X |
| 4,143,669 | 3/1979 | Minkin | 134/200 X |
| 4,192,197 | 3/1980 | Cicatelli | 74/380 |
| 4,350,174 | 9/1982 | Bolten et al. | 134/153 |
| 4,815,372 | 3/1989 | Dekeyser et al. | 74/405 |
| 4,960,006 | 10/1990 | Moore | 74/380 |

FOREIGN PATENT DOCUMENTS

| | | | |
|---|---|---|---|
| 523216 | 9/1931 | Germany | 476/64 |
| 1230302 | 8/1966 | Germany | 134/94 |

OTHER PUBLICATIONS

Hydro–Blast, Inc., "Hydro–Blast Environmentally Safe Automatic Cabinet Parts Washers" brochure, 2 pages.

JBI Industries, Brochure for Front Load Models PCS 1000 and PCS 2000/3000.

Better Engineering, 1992 Catalog for "The Purifiers".

Intercont Products, 1992 Product Catalog.

Hotsy Tubs 1990 Brochure.

*Primary Examiner*—Frankie L. Stinson

*Attorney, Agent, or Firm*—Hovey, Williams, Timmons & Collins

[57] ABSTRACT

A parts washing machine is provided for cleaning and degreasing, e.g., automotive parts which includes a tray rotatably mounted within an enclosure. A drive mechanism is provided for rotating the tray which includes a drive member such as a gear which is mounted on a pivot arm for operative engagement with the tray. By positioning the drive axis of the drive member more proximate to the circumferential wall of the tray than the pivot axis, the drive member remains in engagement with little or no additional force required to maintain a driving relationship between the drive member and the tray.

9 Claims, 2 Drawing Sheets

PARTS WASHING MACHINE

BACKGROUND OF THE INVENTION

1. Field of the Invention

This invention is broadly directed to an apparatus for washing mechanical parts carried by a tray or the like within an enclosure, and is more particularly directed to the drive mechanism for rotating the tray during the washing cycle.

2. Description of the Prior Art

Parts washing machines as described herein are designed to spray mechanical parts which are often large and heavy. The parts are typically covered with oil, grit or grease which must be removed before the mechanic can do further work. The parts are most often made of metal and may be damaged or may cause damage to a machine in which they are washed unless treated with care. On the other hand, parts washing machines must routinely handle loads in the range of 500 up to 4000 pounds, which requires great ruggedness throughout.

Many prior art machines have used solvents or the like to remove the grease and debris, but these solvents are increasingly disfavored for environmental reasons as they often pose hazardous wastes. As an alternative, machines which heat water and biodegradable detergents offer an advantage over the older style of machines.

In order to effectively clean the parts, they are often carried on baskets, shelves or trays so that spray nozzles can direct a cleaning fluid to remove the dirt and grime. In order to use effective and rugged spray apparatus, an enclosure is often provided and the tray on which the parts are mounted rotates to present different sides of the parts to the spray generated by the nozzles.

One problem which has been particularly vexing to those skilled in the art concerns the mechanism for driving the tray during rotation. Whether using rubber tires to frictionally engage the outer wall of the tray, or the use of a sprocket to drive a chain wrapped around the outer wall of the tray, these prior art mechanisms have proven to be prone to breakdown and excessive maintenance. The prior art drive mechanisms have heretofore required that the drive member be biased against the tray to maintain driving engagement. The biasing force, applied by springs or the like, exceeds forty pounds. Typically, the recommended transverse load on the bearings of the drive motors for the prior art machines has been about twelve pounds. As a result, premature bearing failure has been a constant problem in the prior art pans washing machines.

SUMMARY OF THE INVENTION

These problems have largely been solved by the parts washing machine of the present invention, which advantageously employs a drive mechanism for rotating the tray which avoids slippage while necessitating little or no biasing force to maintain engagement between the drive member and the tray.

Broadly speaking, the present invention includes an enclosure, such as a cabinet, for receiving therein a tray on which the parts are received during washing. The tray is supported within the enclosure for rotation to present different sides or aspects of the parts to spray nozzles within the enclosure. The tray is rotated within the enclosure by a drive mechanism which includes a motor and a drive member. The drive member is mounted on a pivot arm whereby the drive member may pivot toward and away from the tray. The tray is rotatably driven by the drive member, with the drive member rotatable about a drive axis that is more proximate the axis of rotation of the tray than the pivot axis. This arrangement provides a self-engaging relationship between the drive member and the tray, whereby virtually no biasing force is required to drive the tray and maintain engagement between the tray and the drive member.

This relationship is enhanced when the drive member is a gear which preferably includes teeth which intermesh with an apertured circumferential wall on the tray. As the teeth engage the circumferential wall, the gear maintains contact with the wall for exerting a substantially tangential drive force on the wall but which also maintains contact between the gear and the wall without slippage. The tray may be a driven tray coupled to other trays within the enclosure to support several groups of parts for simultaneous rotation. A small, supplemental spring may exert a limited biasing force of, e.g., 3 or 4 pounds in a generally radial direction relative to the tray, to further ensure engagement without the necessity of excessive bearing loads in excess of manufacturers specifications.

The parts washer hereof also recirculates the washing fluid, which is preferably a mixture of water and biodegradable detergent. The water is heated prior to being pumped through multiple spray nozzles under pressure. The fluid is then filtered and retained in a reservoir prior to recirculation, whereby the same fluid may be used repeatedly.

These and other features of the present invention will be readily appreciated by those skilled in the art with reference to the drawings and the written specification which follows.

DESCRIPTION OF THE PREFERRED EMBODIMENT

Figure 2:
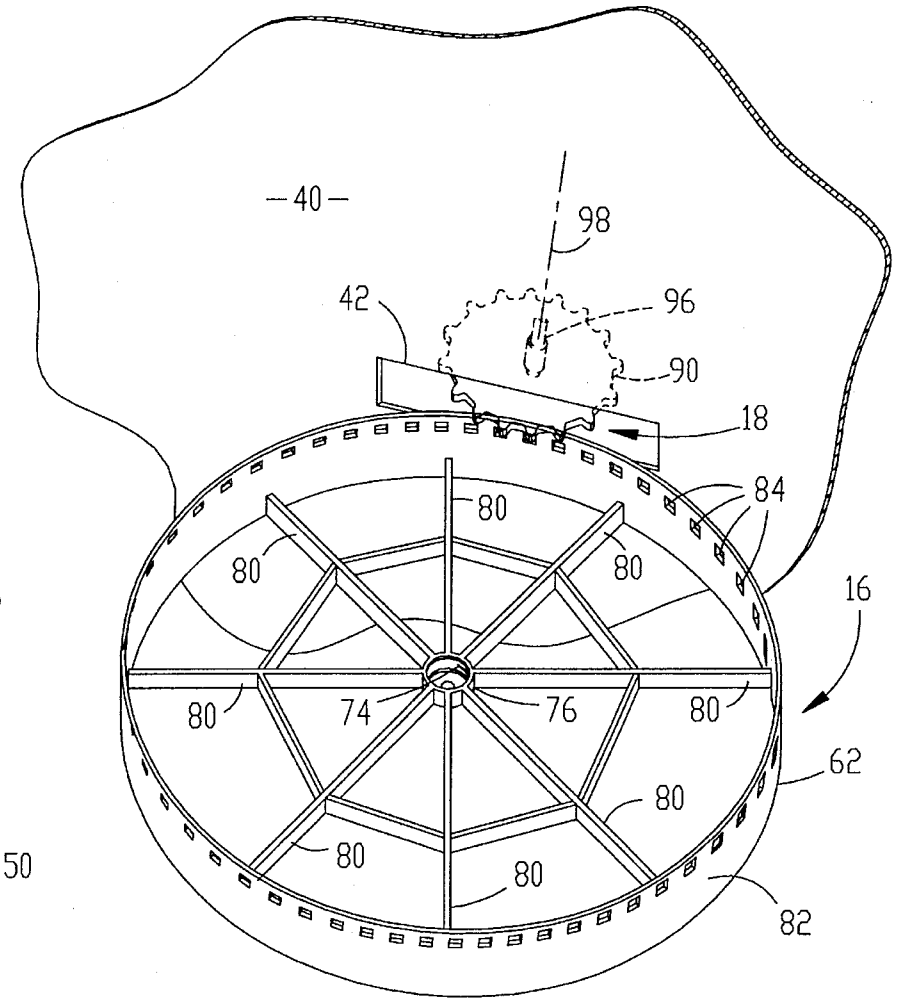
FIG. 2 is a diagrammatic view of the tray, the rear wall of the enclosure and a gear for driving the tray of the present invention.
Figure 1:
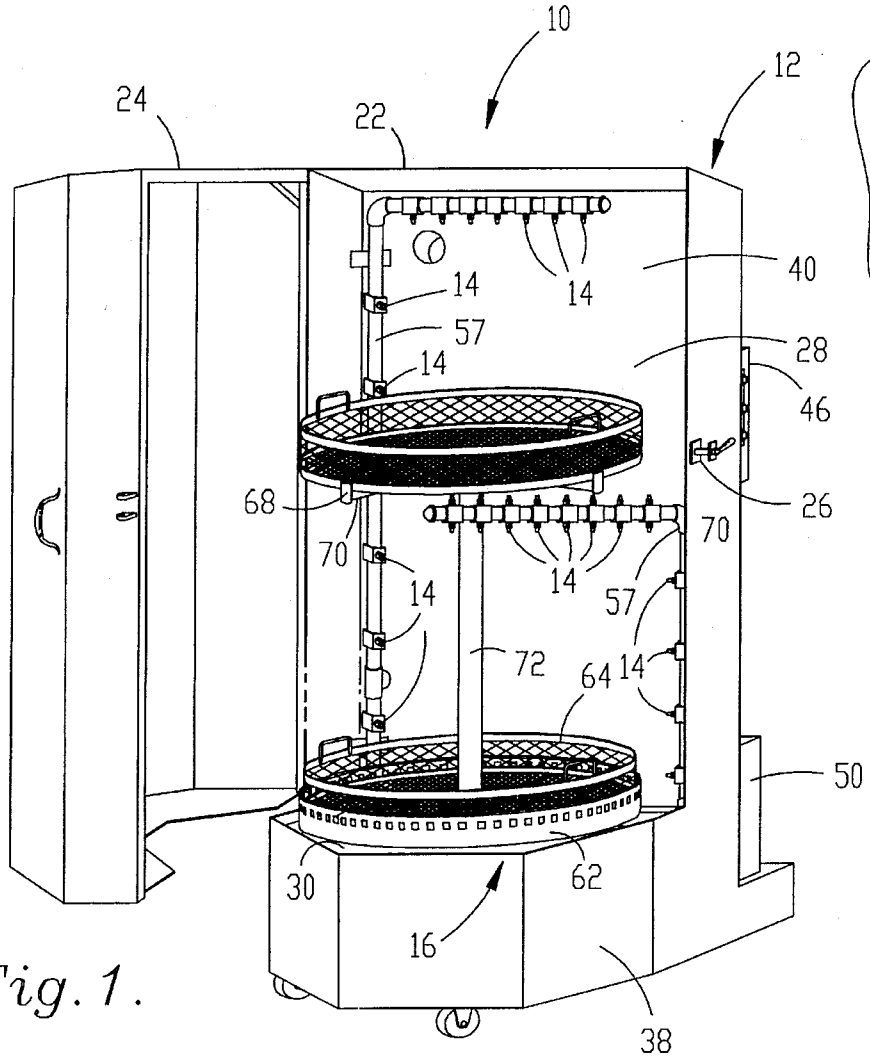
FIG. 1 is a right front perspective view of the parts washing machine of the present invention showing an enclosure, a driven tray, and spray nozzles for washing parts placed onto the tray.

Referring now to the drawing, a parts washing machine 10 in accordance with the present invention broadly includes an enclosure 12, a plurality of spray nozzles 14, at least one tray 16, and a drive mechanism 18. The machine 10 also includes a fluid circulation system 20 for providing a source of cleaning fluid preferably comprised of water and a biodegradable detergent to wash the parts placed on the tray 16.

Figure 4:
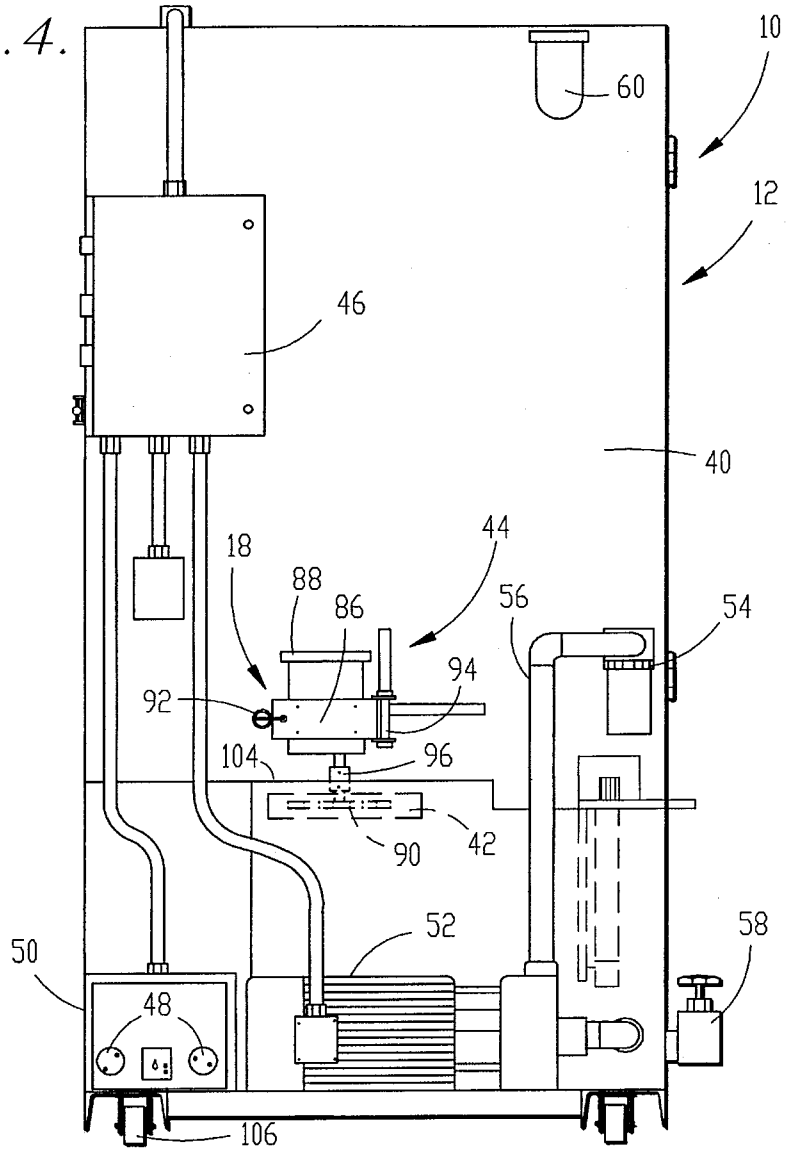
FIG. 4 is a rear elevation view of the present invention showing the pivot arm for pivotally mounting the motor and gear for driving the tray hereof.

In greater detail, the enclosure 12 includes a cabinet 22 and a reservoir 38 for the cleaning fluid. The cabinet 22 includes a hingedly mounted door 24 which may be secured in a closed position by latch 26. The cabinet 22 thus defines an enclosed chamber 28 within which the tray 16 and nozzles 14 are located for spraying the mechanical parts. The chamber is separated from the reservoir 38 by a floor 30, which is provided with openings 32 to permit the cleaning fluid to return to the reservoir 38 after spraying. Typically, two or more openings 32 are provided in the floor 30 and lead to the reservoir 38, each having a screen 34 for catching any smaller parts or preventing large debris from entering the reservoir 38. A hub 38 is mounted on the floor 30 for receiving a turntable 62 thereon. The cabinet 22 also includes a back wall 40 provided with an access 42 as best seen in FIGS. 2 and 4 for preventing the drive mechanism 18 from being completely exposed to the spray from the nozzles 14. A pivot mount 44 extends rearwardly from the back wall 40 for supporting the drive mechanism 18, as will be explained in detail hereinafter.

The enclosure 12 also carries a control box 46 which includes switches, such as timer switches, for activating the fluid circulation system 20 and the heater box 50 for providing electricity to U-shaped electric resistance heating elements 48 (shown in phantom in FIG. 3) within the reservoir. Electricity is received from a remote source and provided through an electrical plug or outlet to the control box 46. The reservoir may contain, for example, 65 gallons of cleaning fluid and the heating elements 48 serve to maintain the fluid at a temperature of about 180° F. during use. The control box 46 also includes switches for activating a pump unit 52 for circulating the fluid under pressure which also activates the drive mechanism 18.

The fluid circulation system 20 circulates heated cleaning fluid through the enclosure 12 under pressure. A preferred pump unit 52 includes an electric motor such as a five horsepower motor by Balder of Ft. Smith, Ark., and a pump such as a close coupled horizontal axis centrifugal pump Model 3656 by Gould Pumps, Inc. yielding a flow of 130 gallons/minute at fifty pounds per square inch pressure. Conduit 56 is positioned on the suction end of the pump unit 52 and receives fluid filtered through a 40 mesh stainless steel cleanable exterior filter 54 from reservoir 38 before discharging the fluid through conduits connected to suitable piping 57 within the cabinet 22 for supplying the nozzles 14.

The tray 16 includes a turntable 62 and a lower basket 64. The turntable 62 is provided for supporting and driving the lower basket 64 on which parts may be placed. The turntable 62 is connected to hub 36 for permitting rotation of the turntable 62. In larger machines 10 hereof, additional baskets such as upper basket 66 may be provided for increasing the capacity of the machine 10. The upper basket 66 is carried on saddle 68 having radially extending legs 70, the saddle being connected to turntable 62 in driven relationship by shaft 72 which is threadably connected to the threads 74 on the inside of central cup 76 of turntable 62. Shaft 72 is coincident with and defines the axis of rotation of the tray 16.

The turntable 62 includes a web-shaped frame 78 including a plurality of radially extending arms 80 connecting the central cup 76 with a circumferential wall 82. The wall 82 presents a plurality of evenly spaced holes 84 therein.

The drive mechanism 18 hereof includes a pivot arm 86, a drive motor 88, a drive member 90, and a biasing spring 92. The pivot arm 86 is pivotally connected to pivot mount 44 and thus to the back wall 40 of the enclosure 12 by a pivot pin 94 which defines a pivot axis. The pivot pin 94, and thus the pivot axis, is upright and substantially parallel to the axis of rotation of the tray 16. The drive motor 88 is connected to the pivot arm 86 by suitable brackets and mounting bolts, and an exemplary drive motor 88 for use in the present invention is Model 3M 126B by Dayton Electric Mfg. Co. of Chicago, Ill. is producing 1/20 horsepower with 113 ft.-lbs. of torque at 6 rpm. An output shaft 96 extends downwardly from the motor and slightly offset to the central axis of the motor. The output shaft 96 is affixed to the drive member 90 and defines the drive axis 98 thereof. The drive axis 98 is located more proximate to both the axis of rotation and the circumferential wall 82 of the tray 16 than the pivot axis defined by the pivot pin 94. Preferably, the drive member 90 is a sprocket gear 100 which presents a plurality of teeth 102 for intermeshing engagement with the holes 84. Biasing spring 92 is located relatively outboard to the drive motor 88 on the pivot arm 86, and thus further away from the pivot axis. Biasing spring 92 is also connected to back wall 40, for holding the drive member 90 in relatively weak tension of only about 3 to 4 pounds against the circumferential wall of tray 16, and serves largely to ensure that the teeth interengage with the holes in the circumferential wall, and in any event far less than the bearing limit of 12 pounds for the typical drive motor 88.

Figure 3:
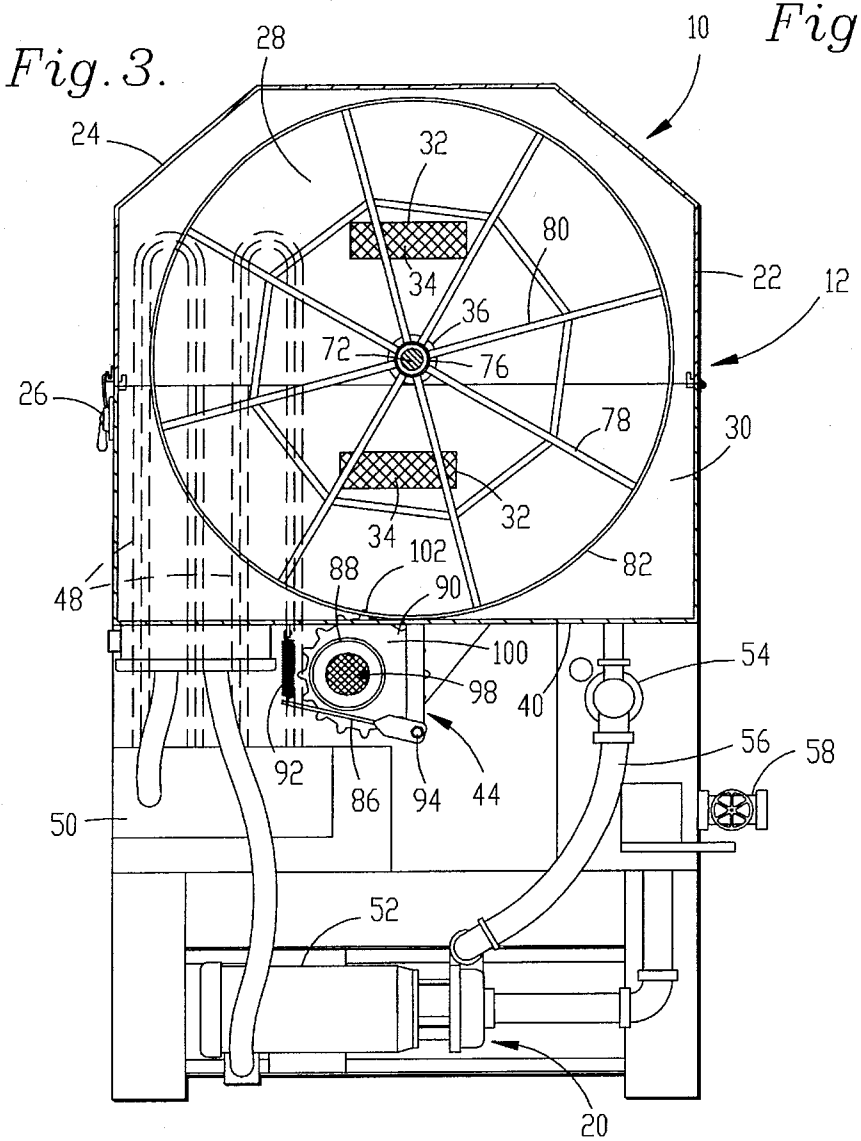
FIG. 3 is a horizontal cross-sectional view of the parts washing machine hereof taken through the enclosure with a cover panel removed to show the drive mechanism including the motor, gear and pivot arm for driving the tray.

A cover panel 104 is provided between the drive motor 88 and the drive member 90 and has been removed in FIG. 3. The cover panel 104 includes an arcuate slot for permitting the output shaft 96 to pass through the slot and swing through an arc when it is desired to disengage the drive member 90 from the tray 16. The enclosure 12 may be provided with wheels 106 to aid in moving the machine 10 to a desired location for storage or use.

The machine 10 as shown and described would have a typical capacity of about 1000 pounds of parts. The mechanical parts to be cleaned are loaded in the baskets 64 and 66 of the tray 16. The door 24 is closed, and the switches on the control box are actuated to heat and circulate the water/detergent cleaning fluid. The fluid is heated by the heating elements 48 in the reservoir 38 and then drawn through the filter 54 into the pump 52 before delivery to pipes 57 and nozzles 14. As the fluid is pumped, the drive motor 88 turns output shaft 96 to turn sprocket gear 100. In the preferred invention, the drive motor 88 includes an overload resistance so that if stalled, it may rotate the output shaft 96 in the opposite direction. Thus, the sprocket gear 100 may be turned in either direction, thus providing for bi-directional rotation of the tray 16. Because of the geometry of the drive mechanism, the teeth 102 and the holes 84 are engaged in a self-engaging manner which largely avoids the need for additional biasing of the gear toward the circumferential wall of the tray 16. As the circumferential wall 82 is turned by the sprocket gear 100, the turntable 62 carries with it lower basket 64 while upper basket 66 is rotated by shaft 72. Thus, the nozzle array can be greatly simplified as different sides of the parts carried by the baskets of the tray 16 are presented in facing relationship to the nozzles.

The debris and grease removed by the hot water/detergent fluid falls onto the floor 30 and is largely carried with the fluid through the openings 32, where it accumulates in the reservoir. The filter 54 serves to remove any additional debris circulating with the fluid. Typical wash cycles will be less than 30 minutes to clean the parts in the baskets.

I claim:

1. In apparatus for washing parts including an enclosure, a tray within said enclosure and rotatable about a tray rotation axis and adapted for receiving parts to be washed, at least one spray nozzle oriented for directing a spray of cleaning fluid onto parts received by the tray, drive means having a motor and a drive member rotatably coupled with and driven by said motor and operatively engaging said tray for rotating the tray, said drive member being rotated about a drive axis, and means mounting said drive member for pivoting movement thereof about a pivot axis spaced from said motor, the improvement which comprises cooperating drive components on said tray and drive member respectively for meshed, driving interengagement between the drive components during rotation of the drive member and tray, and structure locating said pivot axis in an upright orientation at a point where the distance between said pivot axis and said tray rotation axis is greater than the distance between said drive axis and said tray rotation axis in order to maintain said driving interengagement between said drive components during rotation of the drive member and tray.

2. An apparatus for washing mechanical parts as set forth in claim 1, wherein said drive member is a sprocket, and said drive component on said drive member comprises a plurality of circumferentially spaced, outwardly extending teeth.

3. An apparatus for washing mechanical parts as set forth in claim 2, wherein said tray includes a circumferential wall, said drive component on said drive component on said tray comprising a plurality of circumferentially spaced openings for receiving corresponding ones of said sprocket teeth.

4. An apparatus for washing mechanical parts as set forth in claim 3, wherein said circumferential wall presents a plurality of holes therethrough which define the drive component on said tray.

5. An apparatus for washing mechanical parts as set forth in claim 4, wherein said drive, axis is located more proximate to said circumferential wall than said pivot axis.

6. An apparatus for washing mechanical parts as set forth in claim 1, wherein said motor is coupled to a pivot arm for pivoting of said arm, motor and drive member about said pivot axis.

7. An apparatus for washing mechanical parts as set forth in claim 1, including means for biasing said drive member into engagement with said tray.

8. An apparatus for washing mechanical parts as set forth in claim 7, wherein said biasing means is coupled to said pivot arm remotely to said pivot axis relative to said drive means.

9. An apparatus for washing mechanical parts as set forth in claim 1, including fluid recycle means for substantially containing and circulating said fluid within said apparatus during washing of the parts.

* * * * *